US005587704A

United States Patent [19]

Foster

[11] Patent Number: 5,587,704

[45] Date of Patent: Dec. 24, 1996

[54] CODE BLUE LIGHT AUDIO AND VISUAL ALARM APPARATUS

[76] Inventor: Samuel T. Foster, 124 Belshaw Ave., Shrewsbury Township, Monmouth County, N.J. 07724

[21] Appl. No.: 523,078

[22] Filed: Sep. 1, 1995

[51] Int. Cl.[6] ..... G08B 23/00

[52] U.S. Cl. ..... 340/573; 340/326; 340/539

[58] Field of Search ..... 340/573, 574, 340/539, 693, 321, 326, 331; 455/68, 70, 95, 100, 352

[56] References Cited

U.S. PATENT DOCUMENTS

| | | | |
|---|---|---|---|
| 3,911,425 | 10/1975 | Muncheryan | 340/573 X |
| 3,913,092 | 10/1975 | Klingenberg | 340/573 X |
| 4,241,332 | 12/1980 | Farque | 340/321 X |
| 4,716,402 | 12/1987 | Francis | 340/321 X |
| 4,731,604 | 3/1988 | Pawlowski, Jr. | 340/574 |
| 4,855,723 | 8/1989 | Fritz et al. | 340/574 X |
| 5,025,247 | 6/1991 | Banks | 340/573 X |

FOREIGN PATENT DOCUMENTS

| | | | |
|---|---|---|---|
| 2227344 | 7/1990 | United Kingdom | 340/574 |

*Primary Examiner*—Thomas Mullen
*Attorney, Agent, or Firm*—Charles I. Brodsky

[57] ABSTRACT

Apparatus is described, plugged into an electrical wall out-let for energization but with a battery back-up, to sound a siren-type tone and to illuminate a flashing blue light when activated by a user by remote control through a transmitter worn by the user as a pendant or otherwise, with the flashing blue light being set in a prominent window at the user's location to alert and guide neighbors, quick-response assistance personnel and passersby, in general, respecting an emergency condition, and with an ON-OFF switch on the transmitter to deactivate the audio alarm while continuing to maintain the visual alarm, as where a silent warning is desired, or where a telephone connection can be had.

7 Claims, 1 Drawing Sheet

CODE BLUE LIGHT AUDIO AND VISUAL ALARM APPARATUS (This Application is the subject of Disclosure Document No. 375,920 filed May 8, 1995.)

FIELD OF THE INVENTION

This invention relates to an audio-visual alarm system, and, more particularly, to such an audio-visual alarm system to alert a user's neighbors, quick-response assistance personnel and passersby, in general, respecting an ongoing emergency situation.

BACKGROUND OF THE INVENTION

Emergency response equipment has been very recently widely publicized in the communications media, particularly on television. Typical is one which features an elderly woman crying "I've fallen and I can't get up". Senior citizens, and particularly the elderly, have turned to such systems, feeling very vulnerable, especially when living alone. While many medical emergencies occur in households each year, those which affect elderly persons and children are especially of concern, particularly when they can range from a serious household accident to an acute illness. Unfortunately, on many occasions, these instances arise when the injured or sick person has no way of alerting someone of the situation. To fill the need, these emergency response products have been developed and advertised. However, several problems have been noted.

Typically, these responsive systems receive, by telephone lines, the report of the emergency situation—and then respond by personnel identifying the location of the party in need, and conveying that to quick-response assistance personnel. These systems, obviously, require the need for telephone equipment, which not every person in need may have—especially the elderly and infirm, on fixed incomes. Secondly, it is widely known that the identification of houses and apartments are difficult at best. Specifically, house numbers are frequently attached to the house itself, and these are consequently often difficult to see from a distance or from a passing vehicle. Particularly pronounced at night, such problem exists even when a prominent house number is provided, but is difficult or impossible to see. Even if illuminated, these house numbers often are attached to homes in suburban areas where the houses are commonly set back from the street and sidewalk by front yards and lawns. As a result, emergency service personnel such as ambulance drivers, firemen and policemen, and medical technicians often lose precious minutes in identifying the proper home during an emergency, and in trying to locate it. Experience has shown that on a great number of occasions, the quick-response personnel have passed the house back-and-forth on several occasions before they can actually identify where the person in need exists in the emergency situation.

A current, more pressing problem, however, concerns the large costs involved in these emergency response situations. In fact, it is not unusual to hear of situations where senior citizens, and the elderly in particular, have been paying $2,500.00–$5,000.00 and more for these emergency response installations, as they usually are sold on a rental basis, of so much each month, beyond an initial installation fee. Newspaper accounts galore have reported the filing of lawsuits by various State Consumer Protection Agencies contending that these operations are nothing more than "ripoffs" with systems that do not operate, do not operate as described during a sales solicitation, and charging exorbitant rates for monthly services, which escalate over the periods of the long-term contracts being sold.

OBJECTS OF THE INVENTION

It is an object of the present invention, therefore, to provide a new and improved alarm system which can be used by the elderly, by children, by those with physical disabilities, and by just about anyone who desires protection, and the ability to be reached as soon as possible when an emergency arises.

It is also an object of the invention to provide apparatus of this type which can be obtained at a relatively inexpensive cost, can be maintained at minimum expense and can be installed simply and without the need for technical training of any sort.

It is another object of the invention to provide such apparatus which would give both an audible and visual alarm of types that will quickly catch the attention of neighbors and passersby in general, who then could respond themselves to the emergency condition, or contact the appropriate police, fire, or hospital facilities serving the locale.

It is a further object of the invention to provide apparatus of this type which, once purchased and installed, essentially involves no further cost other than periodic replacement of batteries, at nominal cost.

SUMMARY OF THE INVENTION

As will become clear from the description that follows, the apparatus of the invention plugs into an electrical wall outlet for energization, but with a battery back-up to sound a siren-type alarm and to illuminate a flashing blue light when activated by a user by remote control through a transmitter worn by the user as a pendant or otherwise. In accordance with the invention, the flashing blue light is set in a prominent window at the user's location—be it in a suburban home or urban apartment (or even in a commercial store window where the user might be working)—, to alert and guide the quick-response assistance personnel and others to where the need exists. In accordance with a preferred embodiment, an ON-OFF switch can be provided on the transmitter to deactivate the audio alarm while still maintaining the visual alarm, as where a silent warning might be desired in the event that a prowler is believed to be at the premises or where the user is able to communicate with others by telephone.

In essence, and as will be described, a coded "blue light" system would then constitute a lighted alarm system which might include an enclosure for housing various electrical components as a radio receiver, the back-up battery system and the audible alarm. When plugged into the electrical outlet, a light receptacle and a bulb could be added atop the enclosure, along with a blue filter reflector. Any appropriate type of audible alarm could be included—such as a single siren tone, rising or falling audio frequencies, pulsating sounds, etc., along with the flashing light, coded "blue", as consistent with the accepted standard to denote emergency conditions as employed by police and ambulance personnel in responding to a call. In this manner, the remote transmitter worn by the user can incorporate a operative push-button, which when depressed activates both the audible and visual alarm. In a second version of the invention, an override button could be provided on the radio control transmitter so as to activate the light only where verbal communication can be had by telephone, or in a situation where a "silent warning" is to be sent out.

In such manner, the code blue light apparatus could be instrumental, as will be described below, in times of emergency for senior citizens as well as for children. Parents, for example, would appreciate having the ability to stay with an injured child, rather than to flag down an emergency vehicle. Elderly persons who have fallen, or who might be having a heart attack, can simply press the button on the remote control transmitter, and alert neighbors of the injury or ailment by the siren alarm and the flashing blue light, even though immobilized. And, as will be appreciated by those skilled in the art, all that simply needs to be had is a radio control receiver connected to the audible and visual alarm, to be activated by a remote control transmitter, powered by an on-board battery, as are available in just about any type of hobby or electronic store. Once so purchased, all that the user would have to do is periodically replace the battery, over time, in a way that is readily understood and simple to the general public having had exposure to these devices over time.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1A:
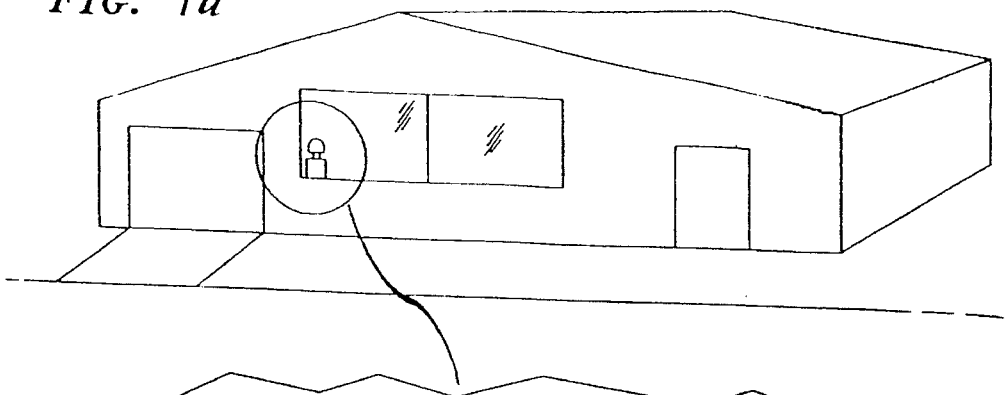
FIG. 1 shows a generally pictorial view of the manner in which the Code Blue Light audio and visual alarm apparatus might be constructed in accordance with the preferred embodiment of the invention.

In the drawings, an enclosure 10 includes a radio receiver 12 which is energized from an electrical wall outlet 14 by connection through a line cord 16 in any appropriate manner. As is understood, a battery back-up 18 is included to become operative in the event that the electrical wall outlet becomes de-energized. Once the radio receiver recognizes an incoming trigger signal, it responds by actuating an audible alarm 20 of any appropriate type to generate a siren tone—be it a constant frequency, rising and/or falling frequencies, pulses, or otherwise, and of a volume to carry hundreds of feet to alert others in adjacent surroundings. As also shown, the enclosure, at an outside surface 11 is provided with a light receptacle 22, a bulb 24 and a visual alarm 26, causing the bulb 24 to flash, intermittently and brightly. Upon the trigger signal being detected by the radio receiver 12, such flashing of the bulb 24 results—and in a preferred embodiment, is surrounded by a reflector 28 and blue filter 30 to provide the high intensity, blue flashing light as an alert, according to the invention.

The radio control transmitter 32 which generates the trigger signal for the receiver 12 is, as previously described, intended to be worn by a user. To such effect, a chain 34 is provided to allow the transmitter 32 to be worn as a pendant, or otherwise, and is powered as by battery 36. In accordance with the invention, an ON-OFF push button or other manually operated switch 38 is shown, which when depressed by a user generates a first trigger signal to actuate the radio receiver 12 so as to sound the siren alarm 20 and so as to activate the visual alarm 26. Actuating the second push button 40, instead, would generate a trigger signal so as to actuate the radio receiver 12 only to activate the flashing bulb alarm 26, as might be advantageous if the user believes that there is a prowler at the location and only wants to send out a "silent alarm", or when the user wishes to deactivate the audible warning being generated so as to telephone 911, or other emergency line system, to verbally advise as to the cause of the problem situation. In either arrangement, the audible and/or visual alarm, once energized, can only be deactivated at the enclosure location 10, itself. Once deactivated, it is simply reset for "arming" purposes, so as to await further activation by depressing either of the push buttons 38 or 40.

Figure 1B:
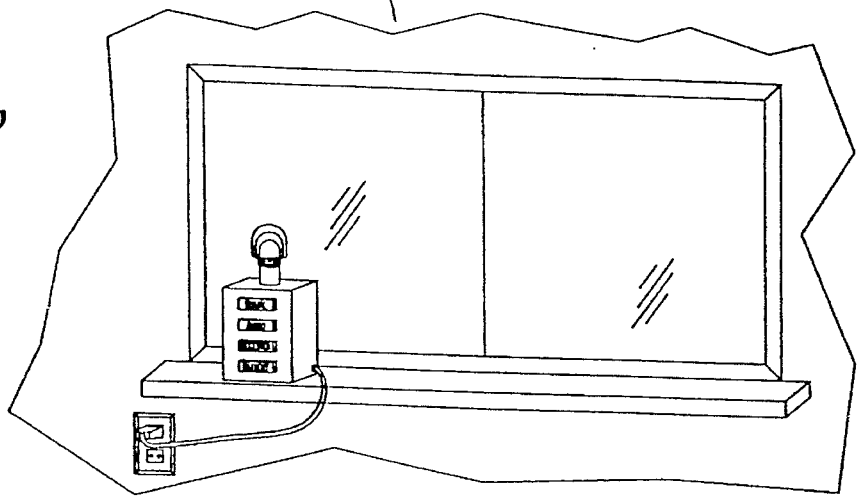
Figure 2:
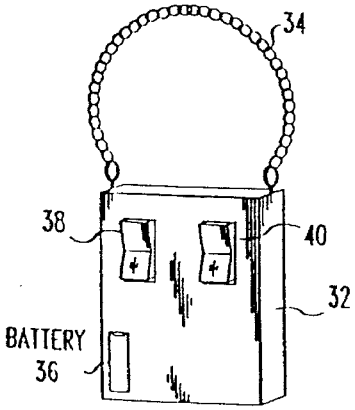
FIG. 2 is a pictorial view of the radio control transmitter to be worn by the user of the system.
Figure 3:
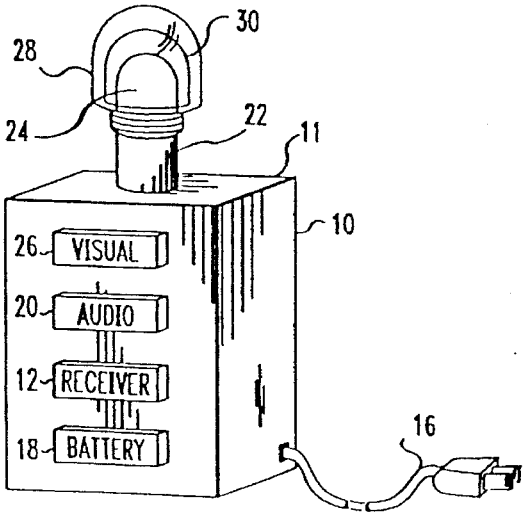
FIG. 3 illustrates, in simplified form, a radio receiver according to the teachings herein.

In accordance with the invention, and as shown in FIG. 1, the enclosure 10, along with its light receptacle, bulb, reflector and filter—or with its visual alarm indication, in general—is placed at a prominent place at the user's location, so that it can be seen by a neighbor, or passerby—and as can serve as an identifying location for any emergency assistance personnel responding to a call that an urgent condition exists at a particular street address. Both the siren alarm and the flashing light will then serve as the beacon for the quick-response assistance personnel to hone in on in answering the call. Obviously, any type of securement of the audible and visual alarm indicators at the window site location can be had, either through a "hanging" emplacement, or through a loop-and-eye adhesive attachment. Preferably surrounding the bulb 24 with the blue filter 30 immediately conveys the impression, accepted in hospital and police emergencies and widely known through television exposure today that a problem situation is present, and immediate attention is, therefore, necessitated.

While there have been described what are considered to be preferred embodiments of the present invention, it will be readily appreciated by those skilled in the art that modifications can be made without departing from the scope of the teachings herein. For example, although the above description has proceeded along the lines of an audible alarm being given in the nature of a "siren", any type of audible alarm can be utilized even to the extent of it being a woman's voice, screaming for "help", as by activating a tape recording of that message as an illustration. For at least such reason, therefore, resort should be had to the claims appended hereto for a true understanding of the scope of the invention.

I claim:

1. Alarm apparatus comprising:

an electrical wall outlet providing a source of electrical energy;

first means for generating an audible alarm-signal;

second means for generating a visual alarm-signal;

third means, including a radio receiver, for coupling said electrical energy to said first and second signal-generating means;

fourth means worn by a user for generating a trigger signal, and including a remote control transmitter and a manually operable switch;

with said radio receiver being normally inoperative to disconnect said source of electrical energy from said first and second alarm-signal generating means and being responsive to the generation of said trigger signal from said fourth means for connecting said source of electrical energy to said first and second alarm-signal generating means for turning on both said audible and visual alarm-signals; and wherein said second means is set in a prominent window at the user's location and includes means for generating a flashing light when energized;

wherein said fourth means also includes a second manually operable switch for generating a second trigger signal, and wherein said radio receiver is responsive to said second trigger signal to connect said source of electrical energy only to said second alarm-signal generating means to only turn-on said visual alarm-signal.

2. The alarm apparatus of claim 1 wherein said second means generates a flashing blue light when energized.

3. The alarm apparatus of claim 1 wherein said first means generates a siren tone when energized.

4. The alarm apparatus of claim 1 wherein said fourth means is coupled for wearing by the user as a pendant.

5. The alarm apparatus of claim 1 wherein said fourth means includes said remote control transmitter and a battery providing a source of electrical energy therefor.

6. The apparatus of claim 1 wherein said first means comprises an audible alarm system, wherein said first and third means are housed within an enclosure plugged into said electrical wall outlet, and wherein said second means includes a light receptacle and bulb externally connected with said enclosure.

7. The apparatus of claim 6 wherein said second means also includes a light reflector with a blue filter.

* * * * *